US008662000B2

(12) United States Patent
Vandenworm

(10) Patent No.: US 8,662,000 B2
(45) Date of Patent: Mar. 4, 2014

(54) STABLE OFFSHORE FLOATING DEPOT

(75) Inventor: Nicolaas J. Vandenworm, Houston, TX (US)

(73) Assignee: SSP Technologies, Inc., Grand Cayman (KY)

( * ) Notice: Subject to any disclaimer, the term of this patent is extended or adjusted under 35 U.S.C. 154(b) by 169 days.

(21) Appl. No.: 13/369,600

(22) Filed: Feb. 9, 2012

(65) Prior Publication Data

US 2012/0132122 A1 May 31, 2012

Related U.S. Application Data

(63) Continuation-in-part of application No. 12/914,709, filed on Oct. 28, 2010, now Pat. No. 8,251,003.

(60) Provisional application No. 61/521,701, filed on Aug. 9, 2011, provisional application No. 61/259,201, filed on Nov. 8, 2009, provisional application No. 61/262,533, filed on Nov. 18, 2009.

(51) Int. Cl.
*B63B 35/44* (2006.01)

(52) U.S. Cl.
USPC ..... 114/263; 114/264

(58) Field of Classification Search
USPC ..... 114/263, 117, 259, 264
See application file for complete search history.

(56) References Cited

U.S. PATENT DOCUMENTS

| | | | | |
|---|---|---|---|---|
| 2,156,635 | A * | 5/1939 | Mascuch et al. | 114/117 |
| 3,041,639 | A * | 7/1962 | Atlas | 441/3 |
| 3,581,692 | A * | 6/1971 | Mortellito | 114/65 R |
| 3,653,354 | A | 4/1972 | Pangalila | |
| 3,763,809 | A | 10/1973 | Pazos | |
| 3,895,495 | A | 7/1975 | Akazaki et al. | |
| 3,919,958 | A | 11/1975 | Graham et al. | |
| 4,174,671 | A | 11/1979 | Seidl | |
| 4,281,615 | A | 8/1981 | Wilson et al. | |

(Continued)

FOREIGN PATENT DOCUMENTS

| | | | |
|---|---|---|---|
| FR | 2748717 | A1 | 11/1997 |
| WO | WO 85/05339 | A1 | 12/1985 |
| WO | WO 2010/030187 | A1 | 3/2010 |

OTHER PUBLICATIONS

Espacenet: Bibliographic Data—Aug. 7, 1998 and English translation of FR2748717(B1) http://worldwide.espacenet.com/publicationDetails/biblio?CC=FR&NR=2748717B1&KC=B1&F http://translationportal.epo.org/emtp/translate/?ACTION=description-retrieval&COUNTRY=FR&FO=2748717(B1).

*Primary Examiner* — Stephen Avila
(74) *Attorney, Agent, or Firm* — Buskop Law Group, PC; Wendy Buskop

(57) ABSTRACT

An offshore depot having a vertically symmetric hull, an upper inwardly-tapered wall and a lower outwardly-tapered wall that produce significant heave damping in response to heavy wave action. Ballast is added to the lower and outermost portions of the hull to lower the center of gravity below the center of buoyancy. The offshore depot includes a tunnel formed within or through the hull at the waterline that provides a sheltered area inside the hull for safe and easy launching/docking of boats and embarkation/debarkation of personnel. When the watertight tunnel doors are all shut, the tunnel may be drained to create a dry dock environment within the hull. The offshore depot includes berthing and dinning accommodations, medical facilities, workshops, machine shops, a heliport, and the like.

26 Claims, 6 Drawing Sheets

(56) References Cited

U.S. PATENT DOCUMENTS

| | | | | | |
|---|---|---|---|---|---|
| 4,282,822 | A | * | 8/1981 | Jackson | 114/222 |
| 4,406,243 | A | | 9/1983 | Kim | |
| 4,565,149 | A | | 1/1986 | Clasky et al. | |
| 4,640,214 | A | * | 2/1987 | Bruns | 114/263 |
| 4,702,189 | A | | 10/1987 | Schlichthorst | |
| 4,735,167 | A | | 4/1988 | White et al. | |
| 4,799,828 | A | | 1/1989 | Georgii | |
| 4,837,989 | A | | 6/1989 | Levy | |
| 4,984,935 | A | | 1/1991 | de Oliveira Filho et al. | |
| 5,065,687 | A | | 11/1991 | Hampton | |
| 5,265,549 | A | | 11/1993 | Cernier | |
| 5,573,353 | A | * | 11/1996 | Recalde | 405/168.3 |
| 5,702,206 | A | | 12/1997 | Quenan et al. | |
| 6,073,573 | A | | 6/2000 | Gruber | |
| 6,340,272 | B1 | | 1/2002 | Runge et al. | |
| 6,340,273 | B1 | | 1/2002 | Hull | |
| 6,371,697 | B2 | | 4/2002 | Huang et al. | |
| 6,401,647 | B1 | | 6/2002 | Boston | |
| 6,431,107 | B1 | | 8/2002 | Byle | |
| 6,539,888 | B1 | | 4/2003 | van der Poel | |
| 6,739,804 | B1 | | 5/2004 | Haun | |
| 6,761,508 | B1 | | 7/2004 | Haun | |
| 6,782,950 | B2 | | 8/2004 | Amin et al. | |
| 6,827,160 | B2 | | 12/2004 | Blair et al. | |
| 6,877,450 | B2 | | 4/2005 | Schmidt et al. | |
| 6,942,427 | B1 | | 9/2005 | Srinivasan | |
| 6,945,736 | B2 | | 9/2005 | Smedal et al. | |
| 6,976,443 | B2 | | 12/2005 | Oma et al. | |
| 6,997,132 | B2 | | 2/2006 | Steen | |
| 7,070,468 | B2 | | 7/2006 | Schmidt | |
| 7,086,810 | B2 | | 8/2006 | Masetti et al. | |
| 7,431,622 | B2 | | 10/2008 | Haun | |
| 7,500,787 | B2 | | 3/2009 | Cioceanu | |
| 7,509,919 | B2 | | 3/2009 | Sebellin | |
| 7,654,211 | B2 | | 2/2010 | Maloney et al. | |
| 7,958,835 | B2 | * | 6/2011 | Srinivasan | 114/264 |
| 8,007,204 | B2 | | 8/2011 | Aubault et al. | |
| 2004/0240946 | A1 | | 12/2004 | Haun | |
| 2004/0258484 | A1 | | 12/2004 | Haun | |
| 2005/0212285 | A1 | | 9/2005 | Haun | |
| 2005/0277344 | A1 | | 12/2005 | Haun | |
| 2005/0281623 | A1 | | 12/2005 | Chianis et al. | |
| 2009/0126616 | A1 | | 5/2009 | Srinivasan | |

* cited by examiner

STABLE OFFSHORE FLOATING DEPOT

CROSS REFERENCE TO RELATED APPLICATION

This application is a continuation-in-part of U.S. patent application Ser. No. 12/914,709 filed on Oct. 28, 2010, now U.S. Pat. No. 8,251,003, which is incorporated herein by reference and which claims the benefit of U.S. Provisional Application No. 61/259,201 filed on Nov. 8, 2009 and U.S. Provisional Application No. 61/262,533 filed on Nov. 18, 2009. This application also claims the benefit of U.S. Provisional Application No. 61/521,701 filed on Aug. 9, 2011, which is incorporated herein by reference.

BACKGROUND OF THE INVENTION

1. Field of the Invention

This present invention pertains generally to offshore buoyant vessels, platforms, caissons, buoys, spars, or other structures used for supporting offshore oil and gas operations. In particular, the present invention relates to a stable moored offshore terminal, such as would be used for safe handling, staging, and transportation of personnel, supplies, boats, and helicopters.

2. Background Art

Stable buoyant structures for supporting offshore oil and gas operations are known in the art. Offshore production structures, which may be vessels, platforms, caissons, buoys, or spars, for example, each typically include a buoyant hull that supports a superstructure. The hull includes internal compartmentalization for ballasting and storage, and the superstructure provides drilling and production equipment, helipads, crew living quarters, and the like.

In offshore work, on drilling and production platforms for example, a major operating cost arises from the transportation of support and supplies from on-shore facilities. Nearly everything must be carried by boat or by air. Such supply lines are subject to adverse weather and sea states, which have greater effect the farther the supplies must travel. Accordingly, stable floating structures designed to be towed out to sea and moored close to several production platforms within a given field are known in the art. These structures may be used to provide shelter for transportation vessels and to provide support facilities, including storage, maintenance, firefighting, medical, and berthing facilities. Such offshore bases, depots, or terminals may provide a reduction in platform operating costs, as they would allow safer and more cost effective transport of personnel and supplied from the shore, which may be temporarily staged and distributed to local platforms. U.S. Pat. No. 4,984,935 issued to de Oliveira Filho et al. discloses one such floating offshore support structure, which includes a sheltered interior for receiving boats.

A floating structure is subject to environmental forces of wind, waves, ice, tides, and current. These environmental forces result in accelerations, displacements and oscillatory motions of the structure. The response of a floating structure to such environmental forces is affected not only by its hull design and superstructure, but also by its mooring system and any appendages. Accordingly, a floating structure has several design requirements: Adequate reserve buoyancy to safely support the weight of the superstructure and payload, stability under all conditions, and good seakeeping characteristics. With respect to the good seakeeping requirement, the ability to reduce vertical heave is very desirable. Heave motions can create tension variations in mooring systems, which can cause fatigue and failure. Large heave motions increase danger in launching and recovery of small boats and helicopters and loading and offloading stores and personnel.

The seakeeping characteristics of a buoyant structure are influenced by a number of factors, including the waterplane area, the hull profile, and the natural period of motion of the floating structure. It is very desirable that the natural period of the floating structure be either significantly greater than or significantly less than the wave periods of the sea in which the structure is located, so as to decouple substantially the motion of the structure from the wave motion.

Vessel design involves balancing competing factors to arrive at an optimal solution for a given set of factors. Cost, constructability, survivability, utility, and installation concerns are among many considerations in vessel design. Design parameters of the floating structure include the draft, the waterplane area, the draft rate of change, the location of the center of gravity ("CG"), the location of the center of buoyancy ("CB"), the metacentric height ("GM"), the sail area, and the total mass. The total mass includes added mass—i.e., the mass of the water around the hull of the floating structure that is forced to move as the floating structure moves. Appendages connected to the structure hull for increasing added mass are a cost effective way to fine tune structure response and performance characteristics when subjected to the environmental forces.

Several general naval architecture rules apply to the design of an offshore vessel. The waterplane area is directly proportional to induced heave force. A structure that is symmetric about a vertical axis is generally less subject to yaw forces. As the size of the vertical hull profile in the wave zone increases, wave-induced lateral surge forces also increase. A floating structure may be modeled as a spring with a natural period of motion in the heave and surge directions. The natural period of motion in a particular direction is inversely proportional to the stiffness of the structure in that direction. As the total mass (including added mass) of the structure increases, the natural periods of motion of the structure become longer.

One method for providing stability is by mooring the structure with vertical tendons under tension, such as in tension leg platforms. Such platforms are advantageous, because they have the added benefit of being substantially heave restrained. However, tension leg platforms are costly structures and, accordingly, are not feasible for use in all situations.

Self-stability (i.e., stability not dependent on the mooring system) may be achieved by creating a large waterplane area. As the structure pitches and rolls, the center of buoyancy of the submerged hull shifts to provide a righting moment. Although the center of gravity may be above the center of buoyancy, the structure can nevertheless remain stable under relatively large angles of heel. However, the heave seakeeping characteristics of a large waterplane area in the wave zone are generally undesirable.

Inherent self-stability is provided when the center of gravity is located below the center of buoyancy. The combined weight of the superstructure, hull, payload, ballast and other elements may be arranged to lower the center of gravity, but such an arrangement may be difficult to achieve. One method to lower the center of gravity is the addition of fixed ballast below the center of buoyancy to counterbalance the weight of superstructure and payload. Structural fixed ballast such as pig iron, iron ore, and concrete, are placed within or attached to the hull structure. The advantage of such a ballast arrangement is that stability may be achieved without adverse effect on seakeeping performance due to a large waterplane area.

Self-stable structures have the advantage of stability independent of the function of mooring system. Although the heave seakeeping characteristics of self-stabilizing floating structures are generally inferior to those of tendon-based platforms, self-stabilizing structures may nonetheless be preferable in many situations due to higher costs of tendon-based structures.

Prior art floating structures have been developed with a variety of designs for buoyancy, stability, and seakeeping characteristics. An apt discussion of floating structure design considerations and illustrations of several exemplary floating structures are provided in U.S. Pat. No. 6,431,107, issued on Aug. 13, 2002 to Byle and entitled "Tendon-Based Floating Structure" ("Byle"), which is incorporated herein by reference.

Byle discloses various spar buoy designs as examples of inherently stable floating structures in which the center of gravity ("CG") is disposed below the center of buoyancy ("CB"). Spar buoy hulls are elongated, typically extending more than six hundred feet below the water surface when installed. The longitudinal dimension of the hull must be great enough to provide mass such that the heave natural period is long, thereby reducing wave-induced heave. However, due to the large size of the spar hull, fabrication, transportation and installation costs are increased. It is desirable to provide a structure with integrated superstructure that may be fabricated quayside for reduced costs, yet which still is inherently stable due to a CG located below the CB.

U.S. Pat. No. 6,761,508 issued to Haun on Jul. 13, 2004 and entitled "Satellite Separator Platform (SSP)" ("Haun"), which is incorporated herein by reference, discloses an offshore platform that employs a retractable center column. The center column is raised above the keel level to allow the platform to be pulled through shallow waters en route to a deep water installation site. At the installation site, the center column is lowered to extend below the keel level to improve vessel stability by lowering the CG. The center column also provides pitch damping for the structure. However, the center column adds complexity and cost to the construction of the platform.

Other offshore system hull designs are known in the art. For instance, U.S. Patent Application Publication No. 2009/0126616, published on May 21, 2009 in the name of Srinivasan ("Srinivasan"), shows an octagonal hull structure with sharp corners and steeply sloped sides to cut and break ice for arctic operations of a vessel. Unlike most conventional offshore structures, which are designed for reduced motions, Srinivasan's structure is designed to induce heave, roll, pitch and surge motions to accomplish ice cutting.

U.S. Pat. No. 6,945,736, issued to Smedal et al. on Sep. 20, 2005 and entitled "Offshore Platform for Drilling After or Production of Hydrocarbons" ("Smedal"), discloses a drilling and production platform with a cylindrical hull. The Smedal structure has a CG located above the CB and therefore relies on a large waterplane area for stability, with a concomitant diminished heave seakeeping characteristic. Although, the Smedal structure has a circumferential recess formed about the hull near the keel for pitch and roll damping, the location and profile of such a recess has little effect in dampening heave.

It is believed that none of the offshore structures of prior art, in particular offshore depots or terminals that are arranged to provide shelter to the boats that used for transportation of supplies and personnel to offshore platforms, are characterized by all of the following advantageous attributes: Symmetry of the hull about a vertical axis; the CG located below the CB for inherent stability without the requirement for complex retractable columns or the like, exceptional heave damping characteristics without the requirement for mooring with vertical tendons, and the ability for quayside integration of the superstructure and "right-side-up" transit to the installation site, including the capability for transit through shallow waters. A buoyant offshore depot or terminal possessing all of these characteristic is desirable.

3. Identification of Objects of the Invention

A primary object of the invention is to provide a buoyant offshore depot or terminal characterized by all of the following advantageous attributes: Symmetry of the hull about a vertical axis; the center of gravity located below the center of buoyancy for inherent stability without the requirement for complex retractable columns or the like, exceptional heave damping characteristics without the requirement for mooring with vertical tendons, and a design that provides for quayside integration of the superstructure and "right-side-up" transit to the installation site, including the capability to transit through shallow waters.

Another object of the invention is to provide a buoyant offshore depot or terminal that may be strategically positioned nearby one or more offshore platforms to act as a safe shelter and distribution point for supply boats, helicopters, stores, and personnel.

Another object of the invention is to provide a buoyant offshore depot or terminal with improved pitch, roll and heave resistance.

Another object of the invention is to provide a buoyant offshore depot or terminal that allows fine tuning of the overall system response to meet specific operating requirements and regional environmental conditions.

Another object of the invention is to provide a buoyant offshore depot or terminal that can be constructed without the need for a graving dock, thereby allowing construction in virtually any fabrication yard.

Another object of the invention is to provide a buoyant offshore depot or terminal that is easily scalable.

SUMMARY OF THE INVENTION

The objects described above and other advantages and features of the invention are incorporated, in a preferred embodiment, in an offshore terminal or depot having a hull symmetric about a vertical axis with an upper vertical side wall extending downwardly from the main deck, an upper inwardly tapered side wall disposed below the upper vertical wall, a lower outwardly tapered side wall disposed below the upper sloped side wall, and a lower vertical side wall disposed below the lower sloped side wall. The hull planform may be circular, oval, elliptical, or polygonal, for example.

The upper inward-tapering side wall preferably slopes at an angle with respect to the vessel vertical axis between 10 and 15 degrees. The lower outward tapering side wall preferably slopes at an angle with respect to the vessel vertical axis between 55 and 65 degrees. The upper and lower tapered side walls cooperate to produce a significant amount of radiation damping resulting in almost no heave amplification for any wave period. Optional fin-shaped appendages may be provided near the keel level for creating added mass to further reduce and fine tune the heave.

The center of gravity of the offshore depot according to the invention is located below its center of buoyancy in order to provide inherent stability. The addition of ballast to the lower and outermost portions of the hull is used to lower the CG for various superstructure configurations and payloads to be carried by the hull. The ballasting creates large righting moments and increases the natural period of the structure to above the period of the most common waves, thereby limiting wave-induced acceleration in all degrees of freedom.

The height h of the hull is preferably limited to a dimension that allows the structure to be assembled onshore or quayside using conventional shipbuilding methods and then towed upright to an offshore location.

The offshore depot includes a tunnel formed within or through the hull at the waterline that provides a sheltered area inside the hull for safe and easy launching/docking of boats and embarkation/debarkation of personnel. The tunnel entrance(s) have watertight doors, which are fitted with robust rubber fenders. The interior of the tunnel may also include fenders to facilitate docking. When the watertight tunnel doors are all shut, the tunnel may be drained to create a dry dock environment within the hull.

The tunnel may include single or multiple branches with multiple penetrations through the hull. The tunnel may include straight, curved, or tapering sections and intersections in a variety of elevations and configurations. The offshore depot is ideally moored so that one or more tunnel entrances are leeward of prevailing winds, waves and currents. In one or more embodiments, disposed within the tunnel is a boatlift assembly. Boatlift assembly is used to raise transport boats so as to eliminate any heave and roll with respect to the offshore depot, thereby establishing a safe condition in which to embark and debark passengers. In addition to or in lieu of a boatlift assembly, high pressure air and/or water nozzles may be disposed at various points in the tunnel below the waterline in order to air raid the water column, thereby influencing the wave and the localized swell action within the tunnel.

The offshore depot includes a superstructure that ideally includes berthing and dinning accommodations, medical facilities, workshops, machine shops, a heliport, and the like. The super structure may also include one or more cranes, davits or the like as appropriate for the services to be provided.

BRIEF DESCRIPTION OF THE DRAWINGS

The invention is described in detail hereinafter on the basis of the embodiments represented in the accompanying figures, in which:

FIG. 1 is a perspective view of a buoyant offshore depot moored to the seabed according to a preferred embodiment of the invention, shown with a superstructure carried by the hull to support offshore operations and with a tunnel formed through the hull for safely receiving small personnel transfer boats and the like;

DESCRIPTION OF THE PREFERRED EMBODIMENTS OF THE INVENTION

Figure 1:
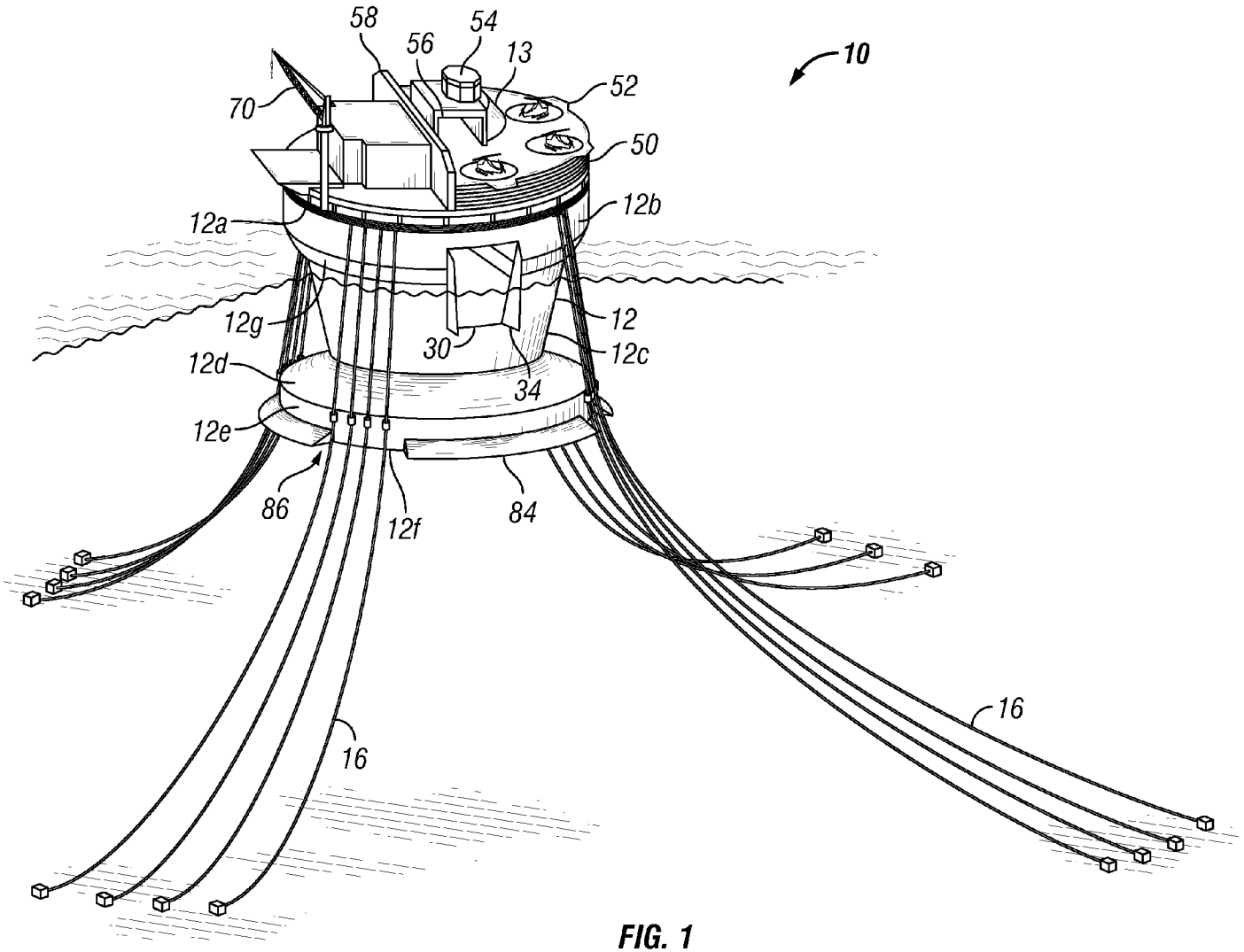

FIG. 1 illustrates a buoyant offshore depot 10 for operationally supporting offshore exploration, drilling, production, and storage installations according to a preferred embodiment of the invention. Offshore depot 10 includes a buoyant hull 12, which may carry a superstructure 13 thereon. Superstructure 13 may include a diverse collection of equipment and structures, such as living quarters for a crew, equipment storage, a heliport, and a myriad of other structures, systems, and equipment, depending on the type of offshore operations to be supported. Hull 12 is preferably moored to the seafloor by a number of catenary mooring lines 16.

Figure 2:
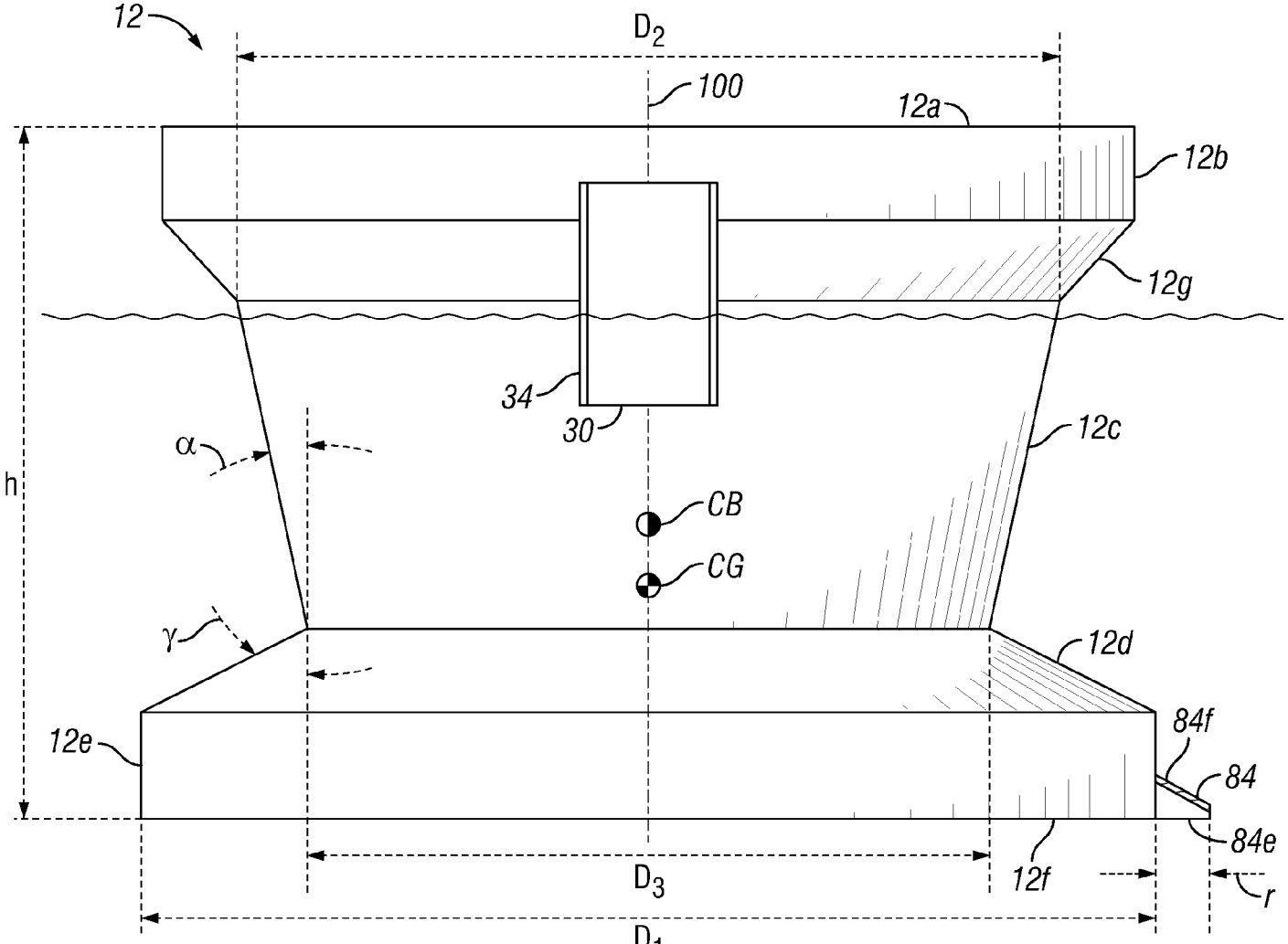
FIG. 2 is an axial cross-sectional drawing of the hull profile of the buoyant offshore depot according to a preferred embodiment of the invention, showing an upper vertical wall portion, an upper inwardly tapered wall section, a lower outwardly tapered wall section, and a lower vertical wall section.

FIG. 2 is a simplified view of the vertical profile of hull 12 according to a preferred embodiment of the invention. Referring both to FIGS. 1 and 2, in a preferred embodiment, hull 12 of offshore depot 10 has a circular main deck 12*a*, an upper cylindrical side section 12*b* extending downwardly from deck 12*a*, an inwardly-tapering upper frustoconical side section 12*c* located below upper cylindrical portion 12*b*, a lower frustoconical side section 12*d* extending downwardly and flaring outwardly from upper frustoconical side section 12*c*, a lower cylindrical side section 12*e* extending downwardly from lower frustoconical section 12*d*, and a flat circular keel 12*f*. Preferably, upper frustoconical side section 12*c* has a substantially greater vertical height than lower frustoconical section 12*d*, and upper cylindrical section 12*b* has a slightly greater vertical height than lower cylindrical section 12*e*. As shown, upper cylindrical section 12*b* may optionally be connected to upper frustoconical transition section 12*g* so as to provide for a main deck of greater radius and a concomitant larger superstructure 13. Transition section 12*g* is ideally located above the waterline.

Circular main deck 12*a*, upper cylindrical side section 12*b*, transition section 12*g*, upper frustoconical side section 12*c*, lower frustoconical side section 12*d*, lower cylindrical section 12*e*, and circular keel 12*f* are all co-axial with a common vertical axis 100 (FIG. 2). Accordingly, hull 12 is characterized by a circular cross section when taken perpendicular to the axis 100 at any elevation.

Due to its circular planform 1, the dynamic response of hull 12 is independent of wave direction (when neglecting any asymmetries in the mooring system, risers, and underwater appendages), thereby minimizing wave-induced yaw forces. Additionally, the conical form of hull 12 is structurally efficient, offering a high payload and storage volume per ton of steel when compared to traditional ship-shaped offshore structures. Hull 12 preferably has round walls which are circular in radial cross-section, but such shape may be approximated using a large number of flat metal plates rather than bending plates into a desired curvature. Although a circular hull planform is preferred, polygonal hull planforms may be used according to alternative embodiments.

In an alternative embodiment (not illustrated), hull 12 may have an oval or elliptical planform. An elliptical shape may be advantageous when depot 10 is moored closely adjacent to another offshore platform so as to allow gangway passage between the two structures. An elliptical hull 12 may minimize or eliminate wave interference from the "battered" shaped platform legs.

The specific design of upper and lower sloped hull walls 12*c*, 12*d* generates a significant amount of radiation damping resulting in almost no heave amplification for any wave period, as described below.

Inward tapering wall section 12*c* is located in the wave zone. At design draft, the waterline is located on upper frustoconical section 12*c* just below the intersection with upper cylindrical side section 12*b*. Upper inward-tapering section 12*c* preferably slopes at an angle α with respect to the vessel vertical axis 100 between 10 and 15 degrees. The inward flare before reaching the waterline significantly dampens downward heave, because a downward motion of hull 12 increases the waterplane area. In other words, the hull area normal to the vertical axis 100 that breaks the water's surface will increase with downward hull motion, and such increased area is subject to the opposing resistance of the air/water interface. It has been found that 10-15 degrees of flare provides a desirable amount of damping of downward heave without sacrificing too much storage volume for the vessel.

Similarly, lower tapering surface 12*d* dampens upward heave. The lower sloping wall section 12*d* is located below the wave zone (about 30 meters below the waterline). Because the entire lower outward-sloping wall surface 12*d* is below the water surface, a greater area (normal to the vertical axis 100) is desired to achieve upward damping. Accordingly, the diameter $D_1$ of the lower hull section is preferably greater than the major diameter $D_2$ of the upper frustoconical section 12*c*. The lower outward-sloping wall section 12*d* preferably slopes at an angle γ with respect to the vessel vertical axis 100 between 55 and 65 degrees. The lower section flares outwardly at an angle greater than or equal to 55 degrees to provide greater inertia for heave roll and pitch motions. The increased mass contributes to natural periods for heave pitch and roll above the expected wave energy. The upper bound of 65 degrees is based on avoiding abrupt changes in stability during initial ballasting on installation. That is, wall surface 12*d* could be perpendicular to the vertical axis 100 and achieve a desired amount of upward heave damping, but such a hull profile would result in an undesirable step-change in stability during initial ballasting on installation.

As illustrated in FIG. 2, the center of gravity of the offshore vessel 10 is located below its center of buoyancy to provide inherent stability. The addition of ballast to hull 12 is used to lower the CG. Ideally, enough ballast is added to lower the CG below the CB for whatever configuration of superstructure 13 (FIG. 1) and payload is to be carried by hull 12.

The hull of depot 10 is characterized by a relatively high metacenter. But, because the CG is low, the metacentric height is further enhanced, resulting in large righting moments. Additionally, the peripheral location of the fixed ballast further increases the righting moments. Accordingly, offshore depot 10 aggressively resists roll and pitch and is said to be "stiff." Stiff vessels are typically characterized by abrupt jerky accelerations as the large righting moments counter pitch and roll. However, the inertia associated with the high total mass of depot 10, enhanced specifically by the fixed ballast, mitigates such accelerations. In particular, the mass of the fixed ballast increases the natural period of the depot 10 to above the period of the most common waves, thereby limiting wave-induced acceleration in all degrees of freedom.

FIGS. 1, 2, 5, and 6 show optional fin-shaped appendages 84 that may be used for creating added mass and for reducing heave and otherwise steadying offshore depot 10. The one or more fins 84 are attached to a lower and outer portion of lower cylindrical side section 12*e* of hull 12. In one or more embodiments as shown, fins 84 comprise four fin sections separated from each other by gaps 86. Gaps 86 accommodate anchor lines 16 on the exterior of hull 12 without contact with fins 84.

Referring to FIG. 2, a fin 84 for reducing heave is shown in cross-section. In a preferred embodiment, fin 84 has the shape of a right triangle in a vertical cross-section, where the right angle is located adjacent a lowermost outer side wall of lower cylindrical section 12*e* of hull 12, such that a bottom edge 84*e* of the triangle shape is co-planar with the keel surface 12*f*, and the hypotenuse 84*f* of the triangle shape extends from a distal end of the bottom edge 84*e* of the triangle shape upwards and inwards to attach to the outer side wall of lower cylindrical section 12*e*.

Figure 5:
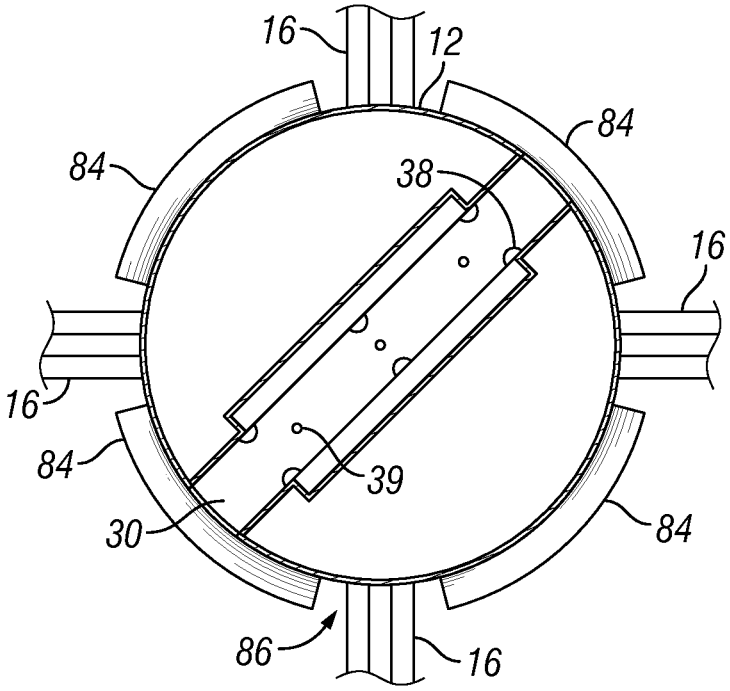
FIG. 5 is a horizontal cross section taken through the hull of the offshore depot of FIG. 1, showing a straight tunnel formed completely therethrough.
Figure 6:
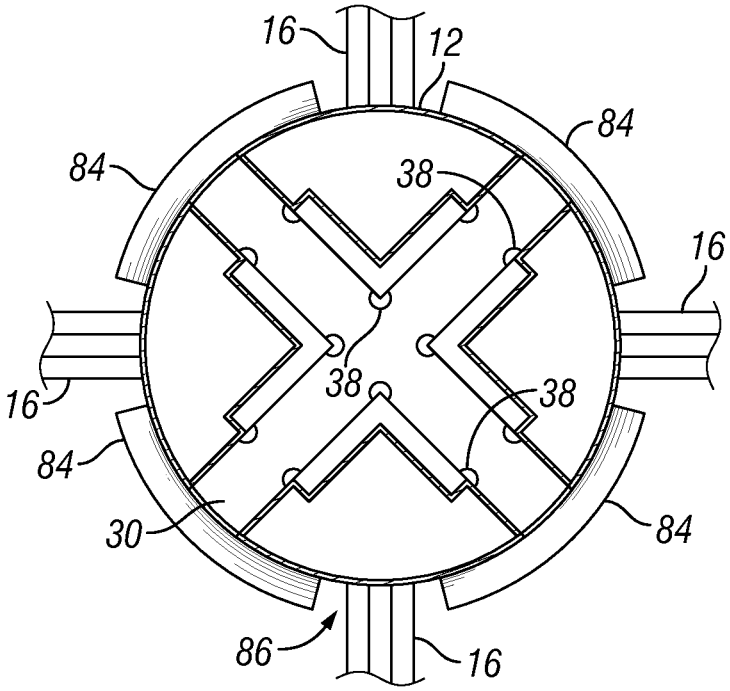
FIG. 6 is a horizontal cross section taken through the hull of an offshore depot according a another embodiment of the invention, showing a cruciform tunnel having entrances formed through the hull at ninety degree intervals.

The number, size, and orientation of fins 84 may be varied for optimum effectiveness in suppressing heave. For example, bottom edge 84*e* may extend radially outward a distance that is about half the vertical height of lower cylindrical section 12*e*, with hypotenuse 84*f* attaching to lower cylindrical section 12*e* about one quarter up the vertical height of lower cylindrical section 12*e* from keel level. Alternatively, with the radius R of lower cylindrical section 12*e* defined as $D_1/2$, then bottom edge 84*e* of fin 84 may extend radially outwardly an additional distance r, where $0.05R \geq r \geq 0.20R$, preferably about $0.10R \geq r \geq 0.15R$, and more preferably $r \approx 0.125R$. Although four fins 84 of a particular configuration defining a given radial coverage are shown in FIGS. 5 and 6, a different number of fins defining more or less radial coverage may be used to vary the amount of added mass as required. Added mass may or may not be desirable depending upon the requirements of a particular floating structure. Added mass, however, is generally the least expensive method of increasing the mass of a floating structure for purposes of influencing the natural period of motion.

It is desirable that the height h of hull 12 be limited to a dimension that allows offshore depot 10 to be assembled onshore or quayside using conventional shipbuilding methods and towed upright to an offshore location. Once installed, anchor lines 16 (FIG. 1) are fastened to anchors in the seabed, thereby mooring offshore depot 10 at a desired location.

As illustrated in FIGS. 1-3, and 5-8, offshore depot 10 includes a tunnel 30 formed within or through hull 12 at the waterline. Tunnel 30 provides a sheltered area inside hull 12 for safe and easy launching/docking of boats and embarkation/debarkation of personnel. Lower tapering surface 12*d* provides a "beach effect" that absorbs most of the surface wave energy at the tunnel entrance(s), thereby reducing slamming and harmonic effects on boats when traversing or moored within tunnel 30. Tunnel 30 may optionally be part of or include a moon pool 150 (FIG. 8) that opens through keel 12*f*. Such a moon pool, if provided, may be open to the sea below, using grating 152 to prevent objects from falling therethrough, for example, or it may be closeable by a watertight hatch (not illustrated), if desired. An open moon pool 150 may provide slightly better overall motion response.

Tunnel 30 has, at every entrance, watertight or weathertight doors 34 that can be opened and closed as required. Doors 34 also function as guiding and stabbing systems, because doors 34 are fitted with robust rubber fenders 36 to reduce potential damage to hull 12 and a small boat 200 should impact occur. The interior of tunnel 30 may also include fenders 38 to facilitate docking. When watertight doors 34 are all shut, tunnel may be drained, using for example, a gravity based draining system or high capacity pumps, so as to create a dry dock environment within hull 12. Weathertight doors, which may include openings below the waterline, may be used in place of watertight doors to allow controlled circulation of water between tunnel 30 and the exterior. Doors 34 may be hinged, or may slide vertically or horizontally as is known in the art.

Tunnel 30 may include single or multiple branches with multiple penetrations through hull 12. Tunnel 30 may include straight, curved, or tapering sections and intersections in a variety of elevations and configurations. For example, FIG. 5 illustrates a straight tunnel 30 that passes completely through hull 12 on a diameter. FIG. 6 illustrates a cruciform tunnel 30 that provides four entrances disposed at ninety-degree intervals about hull 12. Offshore depot 10 is ideally moored so that one or more tunnel entrances are leeward of prevailing winds, waves and currents.

Figure 7:
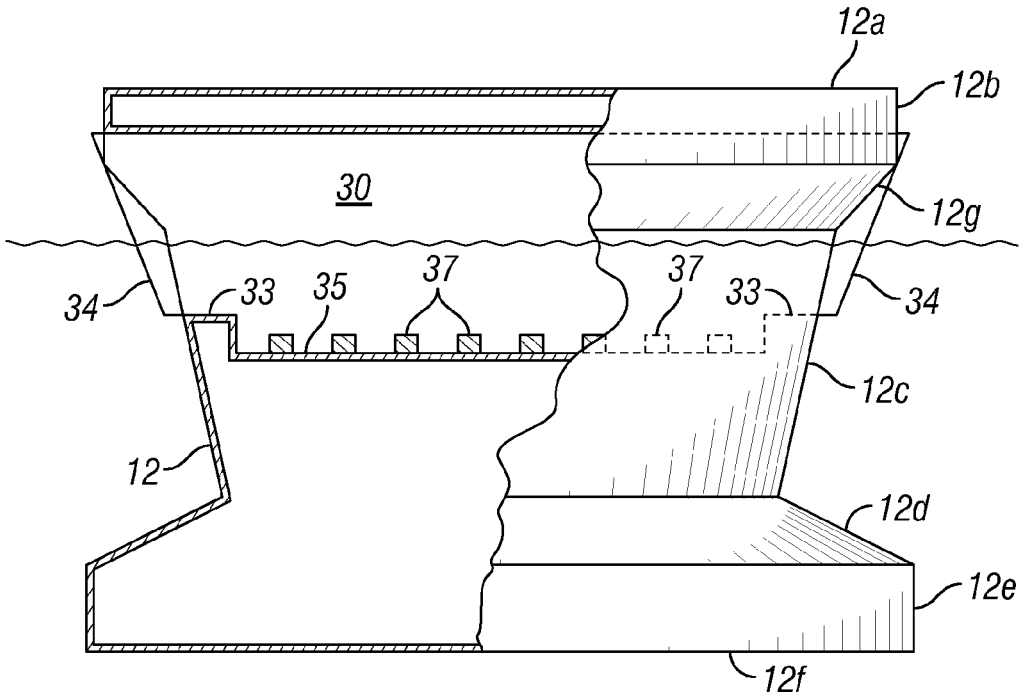
FIG. 7 is an elevation side view in partial cross section of the hull of the offshore depot of FIG. 1, showing optional baffles for reducing waves within the tunnel.
Figure 8:
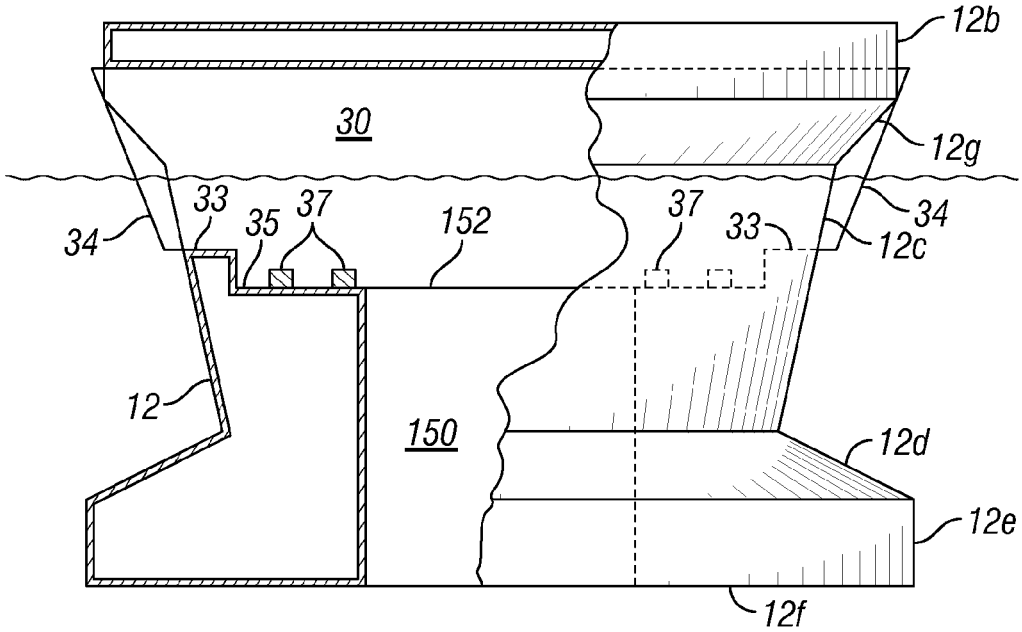
FIG. 8 is an elevation side view in partial cross section of the hull of an offshore depot according to an alternate embodiment of the invention, showing a moon pool opening between the tunnel and the keel and optional baffles for reducing waves within the tunnel.

FIGS. 7 and 8 illustrate optional thresholds 33 disposed near the entrances of tunnel 30, which reduce wave energy entering tunnel 30. One or more interior baffles 37 may be included on the tunnel floor 35 to further reduce the propensity for sloshing within tunnel 30.

In one or more embodiments, disposed within tunnel 30 is a boatlift assembly 40. Boatlift assembly 40 may include a rigid frame 42 carrying chocks 44 that are positioned and arranged for supporting boat 200. In a preferred embodiment, frame 42 is formed of I-beams in a rectangular shape of approximately 15 meters by 40 meters with a safe working load of 200 to 300 tons. Such a frame 42 is suitable for hoisting a fast transport unit ("FTU")—an aluminum water-jet-propulsion trimaran crew boat capable of transporting up to 200 persons with a transit speed of up to 40 knots. A drive assembly 46, which may include rack and pinion gearing, piston-cylinder arrangements, or a system of running rigging, for example, raises and lowers frame 42 with its payload. Boatlift assembly is preferably capable of lifting boat 200 1 to 2 meters or more so as to eliminate any heave and roll of boat 200 with respect to depot 10, thereby establishing a safe condition in which to embark and debark passengers.

In addition to or in lieu of boatlift assembly 40, high pressure air and/or water nozzles 39 (FIG. 5) may be disposed at various points in tunnel 30 below water in order to air raid the water column, thereby influencing the wave and the localized swell action within tunnel 30.

As an alternative to using an active boatlift assembly to raise boat 200, the offshore depot 10 can be ballasted to lower its position in the water to allow boat 200 to enter tunnel 30. Once boat 200 is positioned above appropriate chocks, offshore depot 10 can be deballasted, thereby raising depot 10 further out of the water, draining water from tunnel 30, and causing boat 200 to be seated in its chocks in a dry dock condition.

In operation, a FTU or similar boat 200 will arrive in the proximity of moored, stable offshore depot 10. Boat 200 ideally approaches the entrance to tunnel 30 that is the most sheltered from the effects of wind, waves, and current. If not already in a flooded state, tunnel 30 is flooded. The corresponding doors 34 are opened, and boat 200 enters tunnel 30 under its own power. Door and tunnel fenders 36, 38, as well as the self-guiding stabbing dock shape of tunnel 30 itself, provides safe and reliable clearance guidance. Fenders 36, 38 also eliminate or drastically reduce riding and bouncing of boat 200 against the internal dock side of tunnel 30. After boat 200 clears the entrance, one or both doors 34 may be shut to reduce wave, wind and swell effects from the outer environmental conditions. Boat 200 is aligned over boatlift assembly 40, optionally aided by the use of controlled and monitored underwater cameras and transporter systems. Boat 200 may then be lifted by boatlift assembly 40 as desired. The reverse procedure will be used to launch boat 200.

Offshore depot 10 can be designed and sized to meet the requirements of a particular application. The dimensions may be scaled using the well known Froude scaling technique. The dimensions of tunnel 30, which can be scaled as appropriate, are approximately 17 meters wide by 21 meters high. Such dimensions are appropriate for the tri-hull FTUs described above.

Figure 3:
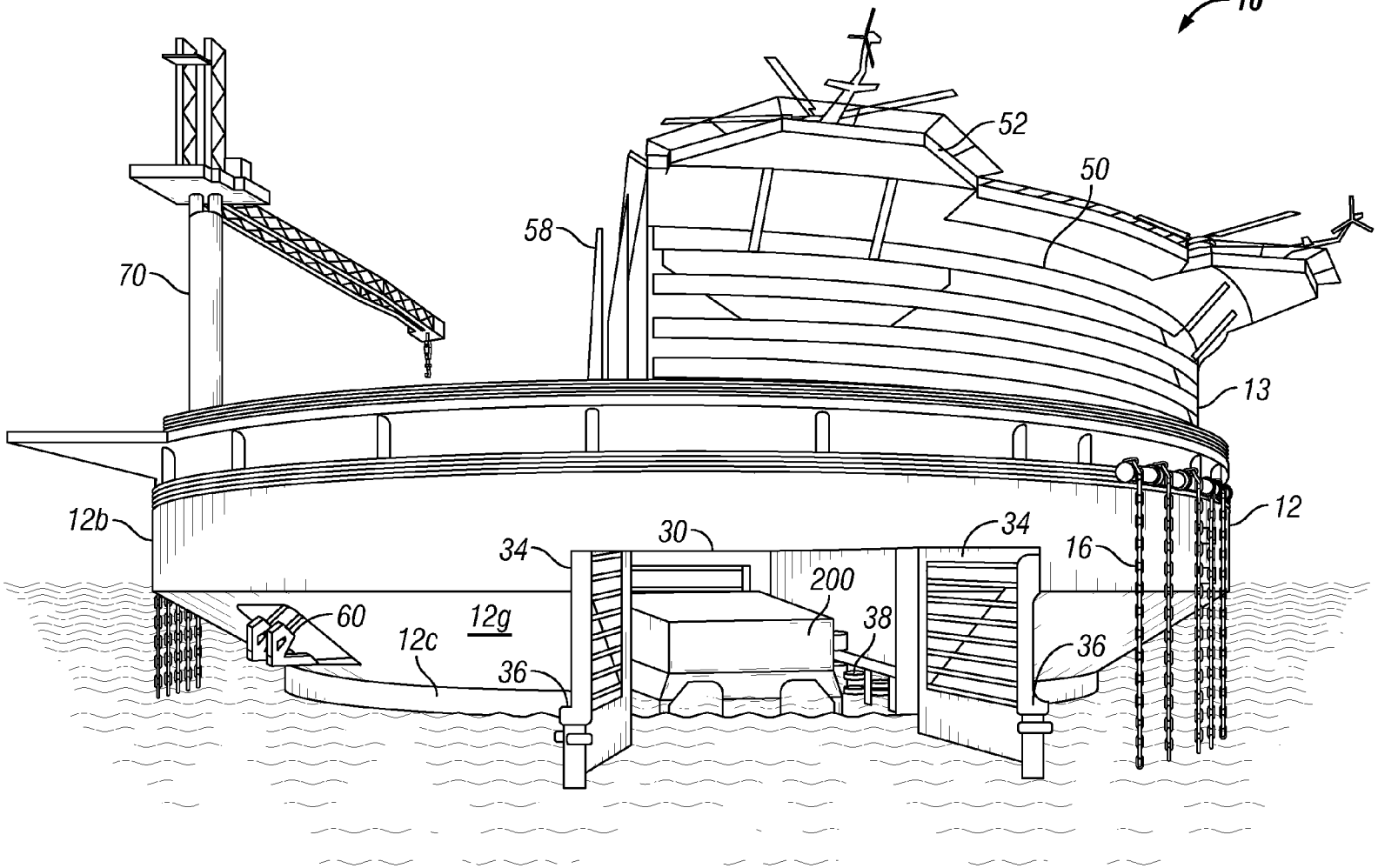
FIG. 3 is an enlarged perspective view of the offshore depot of FIG. 1, showing detail of the tunnel, tunnel doors, and a small personnel transfer boat moored therein.
Figure 4:
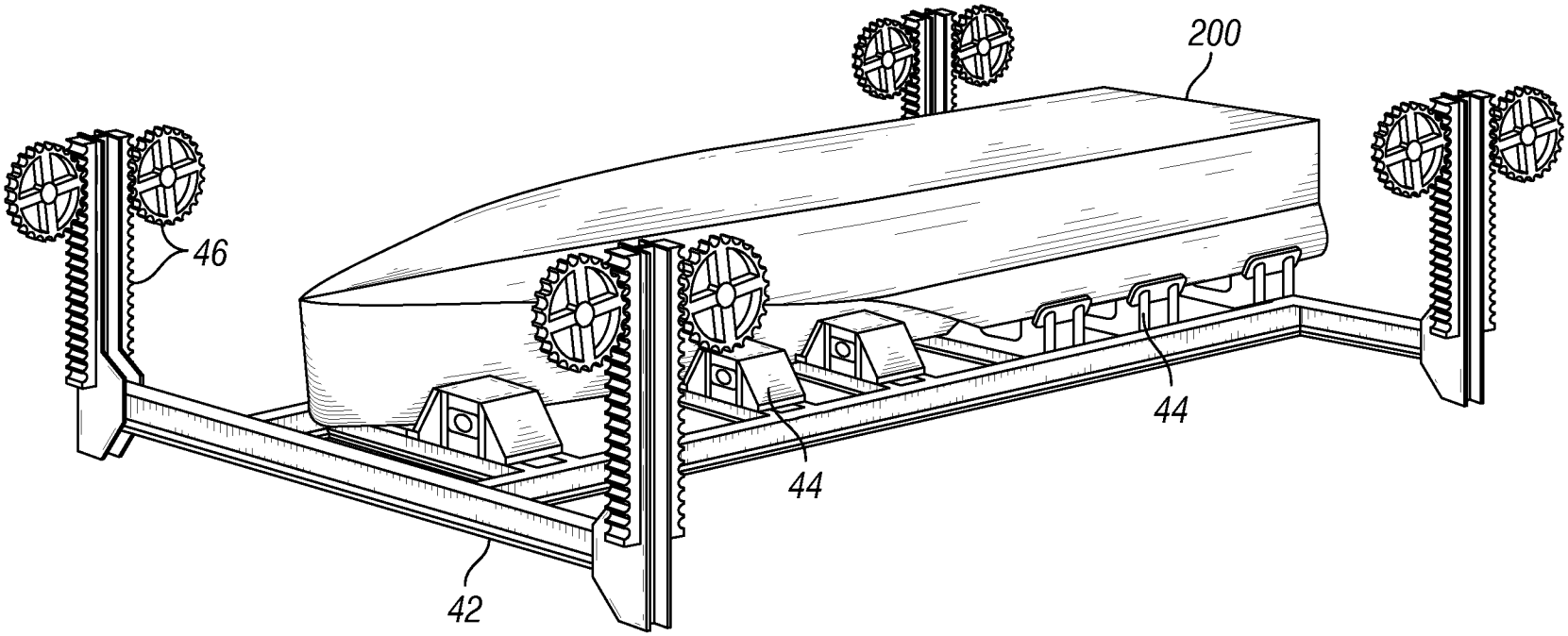
FIG. 4 is a perspective view of a boatlift assembly of the offshore depot of FIG. 1 that is, according to a preferred embodiment, disposed within the tunnel.

In addition to tunnel 30, hull 12 includes storage compartments, which may by used for hydrocarbon products, diesel-fuel-marine for boats, jet propulsion fuel such as JP-5 for helicopters, and potable water, for example, and ballast compartments. As shown in FIG. 3, the exterior of hull 12 may include one or more hard points upon which bitts, padeyes, tow pads 60, or similar connection devices are mounted that can be used to tow offshore depot 10 or moor other vessels.

Superstructure 13 may include berthing and dinning accommodations 50, medical facilities, workshops, machine shops, and the like. One or more helo decks 52, a control tower 54, aircraft hangers 56, and a jet-blast wall 58, are preferably provided. Super structure 13 may also include one or more cranes 70, davits or the like as appropriate for the services to be provided.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A buoyant structure (10) comprising: a hull (12) characterized by an upper frustoconical portion (12*c*) having inward-sloping walls disposed above a lower frustoconical portion (12*d*) having outward-sloping walls with a circular keel; and a tunnel (30) with a tunnel floor (35) formed within said hull at a waterline elevation, said tunnel (30) said tunnel comprising a first opening in said hull opening to an exterior of said hull and dimensioned so as to receive a watercraft (200) therein, a boatlift assembly (40) disposed within said tunnel (30) for lifting the watercraft (200) over the waterline while contained in the tunnel, and a main deck (12*a*) secured to said hull that completely covers said tunnel (30).

2. The structure (10) of claim 1 further comprising: a door (34) disposed at the first opening of said tunnel (30) in said hull (12) so as to provide for selective isolation of said tunnel from said exterior; whereby said tunnel is operable in either a wet condition or a dry condition while said structure (10) floats in a body of water.

3. The structure (10) of claim 2 wherein: said door (34) is a watertight door; whereby said tunnel can be maintained in either a wet condition or a dry condition while said structure (10) floats in a body of water.

4. The structure (10) of claim 1 wherein: said tunnel (30) comprises a second opening in said hull to said exterior.

5. The structure (10) of claim 4 wherein: said tunnel (30) includes first and second branches, wherein each branch has a penetration through the hull (12).

6. The structure (10) of claim 5 wherein: said tunnel (30) is formed in a cruciform shape and further defines third and fourth openings in said hull to said exterior.

7. The structure (10) of claim 1 wherein: said hull (12) comprises the main deck (12*a*) that carries a superstructure (13) thereon; and said superstructure includes at least one member selected from the group consisting of: a berthing facility, accommodations, a heliport, a crane, a control tower, and an aircraft hangar.

8. A buoyant structure (10) comprising: a hull (12) characterized by a generally circular horizontal cross-section and a circular keel; and a tunnel (30) with a tunnel floor (35) formed within said hull at a waterline elevation, said tunnel (30) formed within said circular horizontal cross-section, said tunnel comprising a first opening in said hull opening to an exterior of said hull and dimensioned so as to receive a watercraft (200) therein, and a main deck secured to said hull that completely covers said tunnel (30), wherein said tunnel (30) comprises: a second opening in said hull to said exterior, first and second branches, wherein each branch has a penetration though the hull (12), and is formed in a cruciform shape and further defines third and fourth openings in said hull to said exterior.

9. The structure (10) of claim 8 further comprising: a door (34) disposed at the first opening of said tunnel (30) in said hull (12) so as to provide for selective isolation of said tunnel from said exterior.

10. The structure (10) of claim 9 wherein: said door (34) is a watertight door; whereby said tunnel can be maintained in either a wet condition or a dry condition while said structure (10) floats in a body of water.

11. The structure (10) of claim 8 further comprising: a boatlift assembly (40) disposed within said tunnel (30).

12. The structure (10) of claim 8 wherein: said hull (12) comprises the main deck (12*a*) that carries a superstructure (13) thereon; and said superstructure includes at least one member selected from the group consisting of: a berthing facility, accommodations, a heliport, a crane, a control tower, and an aircraft hangar.

13. The structure of claim 8 further comprising: baffles for reducing waves within the tunnel.

14. The structure of claim 8 further comprising: a moon pool engaging the tunnel and the moon pool opens through the circular keel.

15. The structure of claim 8 further comprising: tunnel fenders disposed within the tunnel to reduce wave action and provide clearance guidance to the watercraft.

16. The structure of claim 8 further comprising: using a self-guiding stabbing dock shape for the tunnel.

17. The structure of claim 8 further comprising: a gangway for traversing between the structure and an adjacent structure.

18. The structure of claim 8 comprising: an oval or elliptical planform for the hull.

19. The structure of claim 8 comprising: the hull with a center of gravity below a center of buoyancy to provide an inherent stability to the structure.

20. The structure of claim 1 comprising: fin-shaped appendages attached to a lower and outer portion of the exterior of said hull.

21. The structure of claim 1 further comprising: a lower tapering surface at an entrance of the tunnel, providing a "beach effect" that absorbs most of a surface wave energy.

22. The structure of claim 14 further comprising: a grating removably disposed over the moon pool.

23. The structure of claim 8 comprising: a gravity based draining system for the tunnel.

24. The structure of claim 8 further comprising: high capacity pumps for draining the tunnel so as to create a dry dock environment within the hull 1.

25. The structure of claim 8 having a straight, curved, or tapering sections in the hull forming the tunnel.

26. The structure of claim 8 comprising: water nozzles disposed at various points in the tunnel below a water surface in order to air raid the water column, influencing wave and localized swell action within the tunnel.

* * * * *